US007837579B2

(12) United States Patent
Bhatt et al.

(10) Patent No.: US 7,837,579 B2
(45) Date of Patent: Nov. 23, 2010

(54) BASEBALL AND SOFTBALL BATS WITH FUSED NANO-STRUCTURED METALS AND ALLOYS

(75) Inventors: Dhananjay Bhatt, Laguna Hills, CA (US); William F. Davidson, III, Huntington BCH, CA (US); Andy Brutlag, Carlsbad, CA (US); Edward Hughes, Encinitas, CA (US)

(73) Assignee: Powermetal Technologies, Inc., Carlsbad, CA (US)

( * ) Notice: Subject to any disclaimer, the term of this patent is extended or adjusted under 35 U.S.C. 154(b) by 0 days.

(21) Appl. No.: 12/052,530

(22) Filed: Mar. 20, 2008

(65) Prior Publication Data

US 2008/0234076 A1 Sep. 25, 2008

Related U.S. Application Data

(60) Provisional application No. 60/895,906, filed on Mar. 20, 2007.

(51) Int. Cl.
*A63B 59/06* (2006.01)

(52) U.S. Cl. ..... 473/566

(58) Field of Classification Search ..... 473/457, 473/519, 520, 564–568
See application file for complete search history.

(56) References Cited

U.S. PATENT DOCUMENTS

| | | | | |
|---|---|---|---|---|
| 3,963,239 | A | | 6/1976 | Fuji |
| 4,323,239 | A | * | 4/1982 | Ishii ..... 473/566 |
| 4,600,193 | A | | 7/1986 | Merritt |
| 5,104,123 | A | | 4/1992 | Okitsu et al. |
| 5,114,144 | A | | 5/1992 | Baum |
| 5,303,917 | A | | 4/1994 | Uke |
| 5,352,266 | A | | 10/1994 | Erb et al. |
| 5,364,095 | A | | 11/1994 | Easton |
| 5,415,398 | A | | 5/1995 | Eggiman |
| 5,433,797 | A | | 7/1995 | Erb et al. |
| 5,511,777 | A | | 4/1996 | McNeely |
| 5,589,011 | A | | 12/1996 | Gonsalves |
| 5,593,158 | A | | 1/1997 | Filice |
| 5,676,610 | A | | 10/1997 | Bhatt |
| 5,984,996 | A | | 11/1999 | Gonsalves |
| 6,033,624 | A | | 3/2000 | Gonsalves |
| 6,042,493 | A | | 3/2000 | Chauvin et al. |
| 6,051,046 | A | | 4/2000 | Schulz et al. |
| 6,053,828 | A | | 4/2000 | Pitsenberger |
| 6,080,504 | A | | 6/2000 | Taylor |
| 6,200,450 | B1 | | 3/2001 | Hui |
| 6,277,170 | B1 | | 8/2001 | Schulz et al. |
| 6,425,836 | B1 | | 7/2002 | Misono |
| 6,461,260 | B1 | | 10/2002 | Higginbotham |
| 6,612,945 | B1 | | 9/2003 | Anderson |
| 7,320,653 | B2 | | 1/2008 | Fitzgerald |

(Continued)

FOREIGN PATENT DOCUMENTS

| | | |
|---|---|---|
| JP | 5-23407 | 2/1993 |

*Primary Examiner*—Mark S Graham
(74) *Attorney, Agent, or Firm*—Fay Sharpe LLP

(57) ABSTRACT

A sports bat, such as a baseball or softball bat, is electro-deposited with a nanostructured metal. Bats made from aluminum alloys or other metals may be electro-deposited with varying thicknesses of nanostructured metals such as nickel, nickel iron, cobalt phosphorous, or similar materials. The bat substrate alloy can be any metal or alloy. The coating may be done using an electro-deposition process.

17 Claims, 12 Drawing Sheets

UNACTIVATED (BARE) BAT

INTERMITTENTLY ACTIVATED BAT

UNACTIVATED (BARE) + FUSED BAT

INTERMITTENTLY ACTIVATED + FUSED BAT

U.S. PATENT DOCUMENTS

| | | | |
|---|---|---|---|
| 7,320,832 | B2 | 1/2008 | Palumbo et al. |
| 2002/0094892 | A1 | 7/2002 | Chauvin et al. |
| 2005/0205425 | A1 | 9/2005 | Palumbo et al. |
| 2006/0135281 | A1 | 6/2006 | Palumbo et al. |
| 2006/0135282 | A1 | 6/2006 | Palumbo et al. |
| 2006/0160636 | A1 | 7/2006 | Palumbo et al. |

* cited by examiner

BASEBALL AND SOFTBALL BATS WITH FUSED NANO-STRUCTURED METALS AND ALLOYS

CROSS REFERENCE TO RELATED APPLICATIONS

This application claims priority from U.S. Provisional Patent Application Ser. No. 60/895,906, filed 20 Mar. 2007, the disclosure of which is incorporated herein by reference.

BACKGROUND

The invention generally relates to bats such as baseball and softball bats having nanostructured metals and alloys fused to their outer surface, or inner surface, or both. More particularly, this invention relates to the design, manufacturing, and construction of adult baseball bats, senior league baseball bats, junior league baseball bats, youth baseball bats, slow pitch softball bats, and fast pitch softball bats having nanostructured metals and alloys fused to their outer surface, or inner surface, or both. The invention also relates to the nanostructured metals and alloys fused on bats with activation layer creating a single-wall barrel structure or without activation creating a multi-wall barrel structure.

BRIEF DESCRIPTION

Due to the competitive nature of many sports, designers are often seeking ways to improve sports equipment. Along this regard, manufacturers have sought out different materials and designs to enhance sports equipment. As can be appreciated, finding a suitable combination of materials and designs to meet a set of performance criteria is a challenging task.

For example, baseball bats were initially made of wood. Over the years, baseball bats that are made of a metal, such as aluminum, gained popularity with respect to wood baseball bats. Metal baseball bats can provide a number of benefits with respect to wood baseball bats, including longer hitting distances and greater durability. At the same time, however, metal baseball bats can suffer from a number of deficiencies. In particular, a metal baseball bat can transmit unpleasant vibrations into the hands and arms of a player. Also, unlike a wood baseball bat, a metal baseball bat can emit a high-pitched metallic sound upon impact that may not be desirable. The bats often dent during the play. Attempts have been made to address the deficiencies of metal baseball bats. In particular, some of these attempts involve multi-layered or multi-walled designs using different materials, such as metals, polymers, and composites. While providing some benefits, these attempts are still lacking in terms of hitting distance and durability as well as in terms of feel and sound upon impact. Moreover, some of these attempts can involve manufacturing techniques that are inefficient in terms of cost and time.

McNeely, in U.S. Pat. No. 5,511,777, teaches a bat having a rebounding core therein. FIG. 1b teaches a compressed resilient attenuator sleeve 26 between the bat barrel 28 and a tubular shaped inner damper 24, preferably of a rigid material.

Eggiman, in U.S. Pat. No. 5,415,398, teaches a softball bat having a tubular insert within the bat barrel. The insert engages the bat toward the two ends of the insert, but therebetween, a gap exists between the bat barrel and the insert. This gap may be filled with grease.

Easton et al., in U.S. Pat. No. 5,364,095, teaches a metal bat having a reinforced fiber composite material on the barrel inside surface.

Baum, in U.S. Pat. No. 5,114,144, teaches a composite bat which may have an extruded aluminum core.

Okitsu et al., in U.S. Pat. No. 5,104,123, teaches a metal baseball bat having a layer of resin foam bonded to the inside wall of the barrel impact portion.

Merritt, in U.S. Pat. No. 4,600,193, teaches a hollow bat having a spider 33, a geodesic support disposed within a bat. FIG. 6 of Meritt shows a six-sided support having inward extending ribs connected at the center.

JP 5-23407 teaches a bat having an inside pipe 9 with ribs 11 extending inward therefrom.

Fujii, in U.S. Pat. No. 3,963,239, teaches a baseball bat having a reinforcing member removably disposed within the barrel portion. FIG. 2 and specification column 3, lines 2-4, teach a tubular cylindrical reinforcing member 16*b* of metal or plastic. The outer periphery of the reinforcing member is in tight engaging relationship with the inner periphery of the barrel.

Uke, in U.S. Pat. No. 5,303,917, discloses a tubular bat with a handle portion and a barrel portion shaped at their innermost ends to telescope and overlap together along a single area of contact. Both portions are not of uniform cross-section, do not extend the full length of the bat, and are not isolated from each other.

Easton, in U.S. Pat. No. 5,364,095, discloses a double-wall bat consisting of an external metal tube and an internal composite sleeve bonded to the inside of the external metal tube and running full length of the barrel portion of the bat.

Chauvin, et al., in U.S. Pat. No. 6,042,493, disclose a double-wall bat with an insert made of titanium and composite materials.

Bhatt, in U.S. Pat. No. 5,676,610, discloses a multi-wall bat having a rolled sheet inserted into the barrel of the bat. Preferably the insert is of spring steel and has a width greater than the inside circumference of the bat barrel so that the edges of the insert overlap within the barrel. The insert provides a trampoline effect to the bat that a single wall bat without insert will not have.

Pitsenberger, in U.S. Pat. No. 6,053,828, discloses a double-wall bat consisting on an internal body and an external shell of constant thickness running full length of the barrel portion in a double-wall construction.

Higginbotham, in U.S. Pat. No. 6,461,260, discloses the bat of U.S. Pat. No. 6,053,828 above with a composite shell formed to an outer shell running full length of the barrel portion of the bat.

Similarly, Misono, in U.S. Pat. No. 6,425,836, discloses a double-wall bat with a lubricated coating between layers or a weak boundary layer formed on the surfaces of the inner member.

Chauvin, in US Patent Pub. 2001/0094892, discloses a double-wall bat consisting of an outer shell and an insert laminate partially bonded to the shell.

In all prior art multi-walled tubular bats, the primary bat frame member and secondary barrel member(s) extend along the entire barrel length and are of constant thickness. Also, the bat members and the barrel portion are not joined, except at their ends, in order to reduce radial stiffness of the barrel portion to improve bat performance. This provides a trampoline effect which is greatest in the central barrel area called the sweet spot. Increasing the barrel portion, or hitting area, increases the sweet spot size similar to increasing the hitting areas of tennis racquets and golf clubs.

Anderson, in U.S. Pat. No. 6,612,945, discloses a multi-wall bat that includes a hollow metallic inner wall having a spiral textured surface and a hollow metallic outer wall surrounding the inner wall. The outer wall lies against the spiral textured surface of the inner wall, whereby the area of contact between the inner and outer walls of the bat is minimized.

Filice, in U.S. Pat. No. 5,593,158, discloses a tubular bat with a handle portion and a barrel portion shaped to overlap along a single area of contact in the taper region and separated by thin elastomeric material to attenuate vibrations. Both bat portions are not of uniform cross-section and do not extend full length of the bat. Such bats only provide minimal relief from sting due to such elastomeric material being highly rate, or time, dependant; that is, the extremely rapid vibrational bat movements, are minimally attenuated.

Fitzgerald, in U.S. Pat. No. 7,320,653, discloses a tubular baseball bat comprising a substantially full length core shaft of preferably constant cross-section, including a handle portion, and a barrel with a gap or separation between the core shaft and barrel, the core shaft and barrel being connected at two or more locations.

The earliest patents for making nanocrystalline metals using electro-deposition processes are U.S. Pat. No. 5,352,266 and U.S. Pat. No. 5,433,797 to Erb et al. These patents disclose a process for producing nanostructured metals and alloys having a grain size of less than 100 nanometers.

Palumbo, et al., in U.S. patent application Ser. No. 11/300,579, disclose a process for at least partially coating a lightweight polymeric material with fine grained metallic material having grain size in the range of 2 nm and 5000 nm; the nano-metal layer having a thickness between 25 μm to 5 cm.

Palumbo, et al., in U.S. Pat. No. 7,320,832, disclose the use of fine grained metallic materials wherein the alloy is chosen such that the CTE (coefficient of Thermal Expansion) matches the substrate, thereby improving the de-lamination performance.

Schulz et. al., in U.S. Pat. No. 6,051,046 and U.S. Pat. No. 6,277,170, disclose nanostructured nickel based alloys having grain size less than 100 nanometers.

Hui, in U.S. Pat. No. 6,200,450, discloses a method for electrodepositing a nickel-iron-tungsten phosphorous alloy to promote wear resistance.

Taylor, in U.S. Pat. No. 6,080,504, discloses a method for depositing nanostructured particles of a catalytic metal on a electrically conductive substrate.

Gonsalves, in U.S. Pat. No. 5,589,011, discloses a steel powder having a grain size in the nanometer range, specifically in the 50 nanometer size, and the steel powder is an alloy composed of iron, chromium, molybdenum, vanadium and carbon.

Gonsalves, in U.S. Pat. No. 5,984,996, discloses nanostructured steel, aluminum, aluminum oxide, aluminum nitride, and other metals having crystallite size ranging from 45 nanometers to 75 nanometers.

Gonsalves, in U.S. Pat. No. 6,033,624, discloses a chemical synthesis method for producing nanostructured metals, metal carbides and metal alloys.

Palumbo et. al., in U.S. Patent Publication 2006/0135281, discloses articles including sporting goods formed by or coated with fine grained metallic materials.

Improvements in baseball and softball bats can be made by making bats that can perform better, hit farther, are more durable, have bigger sweet spots, are more forgiving, and have less vibrations. It is against this background that need arose to develop the sports articles described herein.

SUMMARY OF THE INVENTION

Aspects of the present invention relate to sports articles. The sports article can be any of a variety of sports equipment and associated components.

In one aspect, the sports article can be any of a variety of sports equipment and associated components including adult baseball bats, youth baseball bats slow-pitch softball bats, fast pitch softball bats, Junior/Senior league baseball bats or any other type of similar bat or hitting device having a variety of lengths and weights (herein after collectively referred to as "sports bats").

In one embodiment, sports bats made from any aluminum alloy or other metals may be coated with different thicknesses between 0.0005" to 0.020" of nanostructured metals. The sports bat substrate can be aluminum or any metal or alloy. The nanostructured metals can be Nickel, Nickel Iron, Cobalt Phosphorous, or similar materials, and may be applied by electro-deposition process.

In some embodiment, surfaces including the outer surface, inner surface, or portions of the outer or inner surfaces of a sports bat may be coated with a nanostructured material.

In one embodiment, the nanostructured metals have an average grain size that is in the range of 2 nm to 100 nm, a yield strength that is in the range of 600 Mega Pascal ("MPa") to 2,750 MPa, and higher at greater strain rates, and a hardness that is in the range of 460 Vickers to 2,000 Vickers.

In one embodiment, enhanced sports bats, which include the aforementioned nanostructured materials electro-deposited over a selected length (e.g., between approximately 6 in. and approximately 16 in.) of a barrel section, a hitting area, and/or a portion of a taper area of the sports bat, have significant improvements in performance, durability, sweet spot, feel, and sound.

In one embodiment, sports bats include a portion that includes a nanostructured material. The nanostructured material includes a metal, and the nanostructured material has an average grain size that is in the range of 2 nm to 100 nm, a yield strength that is in the range of 600 MegaPascal ("MPa") to 2,750 MPa, and a hardness that is in the range of 460 Vickers to 2,000 Vickers.

In another embodiment, a sports bat includes a metal shaft, tube, or the like incorporating a metallic coating representing at least 5%, such as more than 10% or more than 20%, and up to 75%, 85%, or 95% of a total weight on a metallic substrate.

In another embodiment, a sports bat includes a portion that includes a first layer and a second layer adjacent to the first layer. At least one of the first layer and the second layer includes a nanostructured material that has a grain size in the submicron range, such as in the nanometer range. Nanostructured materials can be formed as outlined in the patent application of Palumbo et al., U.S. patent application Ser. No. 11/305,842, entitled "Sports Article Formed Using Nanostructured Materials" and filed on Dec. 9, 2004, and the patent application of Palumbo et al., U.S. patent application Ser. No. 10/516,300, entitled "Process for Electro-plating Metallic and Metal Matrix Composite Foils, Coatings and Microcomponents" and filed on Dec. 9, 2004, the disclosures of which are incorporated herein by reference in their entirety.

An improved process can be employed to create high strength, equiaxed coatings on metallic components or on non-conductive components that have been metallized to render them suitable for electro-plating. In an alternative embodiment, the process can be used to electro-form a stand-alone article on a mandrel or other suitable substrate and, after reaching a desired plating thickness, to remove the free-standing electro-formed article from the temporary substrate.

In the process of an embodiment of the invention, an improved process can be employed to create high strength, equiaxed coatings on metallic components or on non-conductive components that have been metallized to render them suitable for such deposition processes as PVD, CVD, or other deposition processes.

In the process of an embodiment of the invention, an electro-deposited metallic coating optionally contains at least 2.5% by volume particulate, such as at least 5%, and up to 75% by volume particulate. The particulate can be selected from the group of metal powders, metal alloy powders, and metal oxide powders of Al, Co, Cu, In, Mg, Ni, Si, Sn, V, and Zn; nitrides of Al, B and Si; carbides of B, Cr, Si, Ti, V, Zr, Mo, Cr, Fe, Ni, Co, Nb, W, Hf and Ta; borides of Ti, V, Zr, W, Hf, Ta, Si, Mo, Nb, Cr, and Fe; $MoS_2$; and organic materials such as PTFE and other polymeric materials. The particulate average particle size is typically below 10,000 nm (or 10 μm), such as below 5,000 nm (or 5 μm), below 1,000 nm (or 1 μm), or below 500 nm According to an embodiment of the invention, patches or sections of nanostructured materials can be formed on selected areas without the need to electro-deposit over an entire article.

According to an embodiment of the invention, patches or sleeves of nanostructured materials, which need not be uniform in thickness, can be electro-deposited in order to form a thicker coating on selected sections or sections particularly prone to heavy use or impact.

Another aspect of the invention relates to the "sweet-spot" of a sports bat. Designers strive to increase the "sweet-spot" of the sports bat to increase the area of the barrel over which striking the ball does not result in harsh vibrations and lower ball speed. A sports bat with a bigger sweet spot is considered more forgiving. Forgiveness in the sports bat can be achieved by increasing the Coefficient of Restitution (C.O.R) of the barrel and placing the center-of-gravity of the sports bat at strategic locations to achieve a desirable swing weight. The C.O.R. of the sports bat can be increased by making the barrel deflect more, or making it more compliant.

Another aspect of the invention relates to a nanometal layer being the impact surface. A nanometal layer with higher hardness will wear or dent significantly less as compared to the current aluminum alloy barrels. Thus the performance will be maintained throughout the sports bat life due to the addition of electro-deposited nanostructured material.

In one embodiment, a substrate or core, such as an aluminum core, of the sports bat may be encapsulated by nanostructured metal. The encapsulation increases the stiffness of the structure. In addition, complete encapsulation prevents the possibility of galvanic corrosion of the aluminum alloy core.

In some embodiments, a substrate or core, such as an aluminum core, of a sports bat need not be encapsulated symmetrically. The location of the core can be chosen depending on the particular application. The encapsulation width along the perimeter of the core i.e. the material covering the perimeter of the aluminum alloy core, can be controlled during the deposition process or could be later machined to the design requirement. In some exemplary embodiments the encapsulation thickness can vary from approximately 0.001 mm to approximately 1 mm, and its width can vary from approximately 0.5 inches to 16 inches, either continuously or intermittently.

Other aspects and embodiments of the invention are also contemplated. For example, another aspect of the invention relates to a method of forming a sports bat. The foregoing summary and the following detailed description are not meant to restrict the invention to any particular embodiment but are merely meant to describe some embodiments of the invention.

BRIEF DESCRIPTION OF THE DRAWINGS

For a better understanding of the nature and objects of some embodiments of the invention, reference should be made to the following detailed description taken in conjunction with the accompanying drawings.

FIG. 10(*b*) is a side cross-sectional view of a sports bat, according to another embodiment of the invention.

FIG. 10(*c*) is a perspective view of a sleeve formed or nanostructured material for a sports bat.

FIG. 11(*b*) illustrates a sports bat with nanostructured material on a barrel portion with intermittent activation.

DETAILED DESCRIPTION

Overview

Figure 1:
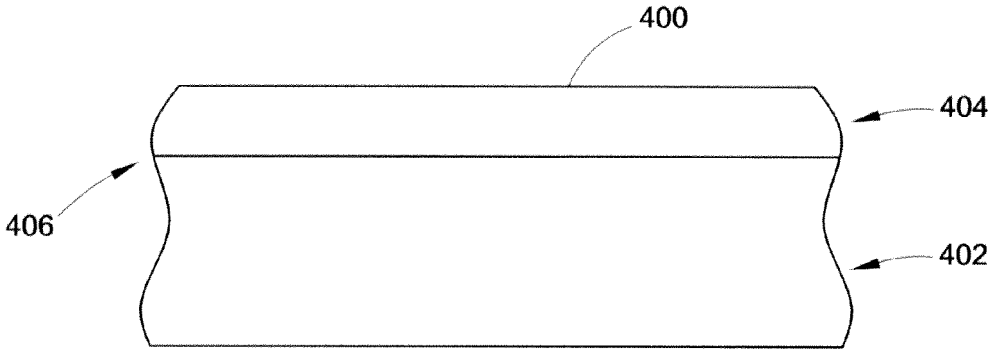
FIG. 1 illustrates a cross-sectional schematic view of a portion of a sports bat, according to an embodiment of the invention, with nanostructured material providing a structural shell or coating.

Sports bats in accordance with various embodiments of the invention can be formed using inserts and nanostructured materials having a number of desirable characteristics. In particular, the nanostructured materials can exhibit characteristics such as high strength, high strength-to-weight ratio, high resilience, high fracture toughness, high elasticity, high vibration damping, high hardness, high ductility, high wear resistance and high corrosion resistance. In such manner, the sports bats can have improved performance characteristics while being formed in a cost-effective manner.

DEFINITIONS

The following definitions apply to some of the features described with respect to some embodiments of the invention. These definitions may likewise be expanded upon herein.

As used herein, the singular terms "a," "an," and "the" include plural referents unless the context clearly dictates otherwise. Thus, for example, a reference to an object can include multiple objects unless the context clearly dictates otherwise.

As used herein, the term "set" refers to a collection of one or more items. Thus, for example, a set of objects can include a single object or multiple objects. Items included in a set can also be referred to as members of the set. Items included in a set can be the same or different. In some instances, items included in a set can share one or more common characteristics.

As used herein, the term "adjacent" refers to being near or adjoining. Objects that are adjacent can be spaced apart from one another or can be in actual or direct contact with one another. In some instances, objects that are adjacent can be coupled to one another or can be formed integrally with one another.

As used herein, the terms "integral" and "integrally" refer to a non-discrete portion of an object. Thus, for example, a baseball bat including a barrel and a handle that is formed integrally with the barrel can refer to an implementation of the baseball bat in which the barrel and the handle are formed as a monolithic unit. An integrally formed portion of an object can differ from one that is coupled to the object, since the integrally formed portion of the object typically does not form an interface with a remaining portion of the object.

As used herein, the term "submicron range" refers to a range of dimensions less than about 1,000 nm, such as from about 2 nm to about 900 nm, from about 2 nm to about 750 nm, from about 2 nm to about 500 nm, from about 2 nm to about 300 nm, from about 2 nm to about 100 nm, from about 10 nm to about 50 nm, or from about 10 nm to about 25 nm.

As used herein, the term "nanometer range" or "nm range" refers to a range of dimensions from about 1 nm to about 100 nm, such as from about 2 nm to about 100 nm, from about 10 nm to about 50 nm, or from about 10 nm to about 25 nm.

As used herein, the term "size" refers to a characteristic dimension of an object. Thus, for example a size of an object that is a spherical can refer to a diameter of the object. In the case of an object that is non-spherical, a size of the object can refer to an average of various dimensions of the object. Thus, for example, a size of an object that is a spheroidal can refer to an average of a major axis and a minor axis of the object. When referring to a set of objects as having a specific size, it is contemplated that the objects can have a distribution of sizes around the specific size. Thus, as used herein, a size of a set of objects can refer to a typical size of a distribution of sizes, such as an average size, a median size, or a peak size.

As used herein, the term "grain size" refers to a size of a set of constituents or components included in a material, such as a nanostructured material. When referring to a material as being "fine-grained," it is contemplated that the material can have an average grain size in the submicron range, such as in the nm range.

As used herein, the term "microstructure" refers to a microscopic configuration of a material. An example of a microstructure is one that is quasi-isotropic in which a set of crystals are relatively uniform in shape and size and exhibit a relatively uniform grain boundary orientation. Another example of a microstructure is one that is anisotropic in which a set of crystals exhibit relatively large deviations in terms of shape, size, grain boundary orientation, texture, or a combination thereof.

As used herein, the term "nanocrystalline" or "nanostructured" refers to materials with an average grain size of 1-100 nm. However, in the context of this application, means average grain sizes are in the range of 1-1,000 nm.

As used herein, the term "coat" is synonymous with fuse, electro-deposition, electro-plate, electroless deposition (EN), chemical vapor deposition (CVD), physical deposition (PVD), and similar processes.

Nanostructured Materials

Certain embodiments of the invention relate to nanostructured materials that can be used for sports bats. A microstructure and resulting characteristics of nanostructured materials can be engineered to meet performance criteria for a variety of sports articles. In some instances, engineering of nanostructured materials can involve enhancing or optimizing a set of characteristics, such as strength, strength-to-weight ratio, resilience, fracture toughness, vibration damping, hardness, ductility, and wear resistance. In other instances, engineering of nanostructured materials can involve trade-offs between different characteristics.

According to some embodiments of the invention, a nanostructured material has a relatively high density of grain boundaries as compared with other types of materials. This high density of grain boundaries can translate into a relatively large percentage of atoms that are adjacent to grain boundaries. In some instances, up to about 50 percent or more of the atoms can be adjacent to grain boundaries. Without wishing to be bound by a particular theory, it is believed that this high density of grain boundaries promotes a number of desirable characteristics in accordance with the Hall-Petch Effect. In order to achieve this high density of grain boundaries, the nanostructured material is typically formed with a relatively small grain size. Thus, for example, the nanostructured material can be formed with a grain size in the submicron range, such as in the nm range. As the grain size is reduced, a number of characteristics of the nanostructured material can be enhanced. For example, in the case of nickel, the hardness can increase from about 140 Vickers for a grain size greater than about 5 μm to about 300 Vickers for a grain size of about 100 nm and ultimately to about 600 Vickers for a grain size of about 10 nm. Similarly, an ultimate tensile strength of nickel can increase from about 400 MPa for a grain size greater than about 5 μm to 670 MPa for a grain size of about 100 nm and ultimately to over 900 MPa for a grain size of about 10 nm, and has been shown to have enhanced yield strength and ultimate tensile strength mechanical properties when tested at high strain rate conditions similar to the impulse shock rates applied to sports bats during normal playing conditions. An example of the high strain rate improvement effect can be seen in the increase in ultimate strength of nanostructured Ni alloys, which have a nominal range of 900-1000 MPa under quasi-static tensile-loading, but which will jump to the 1400-1500 MPa range at high strain rates with corresponding improvements in ductility from 4-6% under quasi-static loading to 10-12% at high strain rates.

According to some embodiments of the invention, a nanostructured material includes a set of crystals that have a size in the nm range and, thus, can be referred to as a nanocrystalline material. However, as described herein, nanostructured materials having desirable characteristics can also be formed with larger grain sizes, such as in the submicron range. A microstructure of the nanostructured material can be engineered to cover a wide range of microstructure types, including one that is quasi-isotropic, one that is slightly-anisotropic, and one that is anisotropic and highly textured. Within this range of microstructure types, a reduction in size of the set of crystals can be used to promote a number of desirable characteristics.

Nanostructured materials can be formed as outlined in the patent application of Palumbo et al., U.S. patent application Ser. No. 11/013,456, entitled "Strong, Lightweight Article Containing a Fine-Grained Metallic Layer" and filed on Dec. 17, 2004, and the patent application of Palumbo et al., U.S. patent application Ser. No. 10/516,300, entitled "Process for Electro-plating Metallic and Metal Matrix Composite Foils, Coatings and Microcomponents" and filed on Dec. 9, 2004, the disclosures of which are incorporated herein by reference in their entirety.

In some instances, a nanostructured material can be formed as a metal matrix composite in which a metal or a metal alloy forms a matrix within which a set of additives are dispersed. A variety of additives can be used, and the selection of a specific additive can be dependent upon a variety of considerations, such as its ability to facilitate formation of the nanostructured material and its ability to enhance characteristics of the nanostructured material. Particularly useful additives include particulate additives formed of: (1) metals selected from the group of Al, Co, Cu, In, Mg, Ni, Sn, V, and Zn; (2) metal alloys formed of these metals; (3) metal oxides formed of these metals; (4) nitrides of Al, B, and Si; (5) C, such as in the form of graphite, diamond, nanotubes, and Buckminster Fullerenes; (6) carbides of B, Cr, Si, Ti, V, Zr, Mo, Cr, Ni, Co, Nb, Ta, Hf and W; borides of Ti, V, Zr, W, Si, Mo, Nb, Cr, and Fe; (7) self-lubricating materials, such as $MoS_2$; and (8) polymers, such as polytetrafluoroethylene ("PTFE"). During formation of a nanostructured material, a set of particulate additives can be added in the form of powders, fibers, or flakes that have a size in the submicron range, such as in the nm range. Depending on specific characteristics that are desired, the resulting nanostructured material can include an amount of particulate additives that is at least about 2.5 percent by volume, such as at least about 5 percent by volume, and up to about 75 percent by volume.

Table 1 below provides examples of classes of nanostructured materials that can be used to form sports bats described herein.

TABLE 1

| Nanostructured Materials | Characteristics |
|---|---|
| n-Ni, n-Ni Fe, n-Co P | high strength, high fracture toughness, high degree of hardness and wear resistance |

The foregoing provides a general overview of some embodiments of the invention.

Sports Bats

Implementations of Sports Bats

With reference to FIG. 1, a cross-sectional schematic view of a portion 400 of a sports bat, according to an embodiment of the invention, is illustrated. For example, the portion 400 can be a body portion 1002 of sports bat 1000 shown in FIGS. 8 and 9, which can include a barrel portion 1004, a tapered portion 1006, a handle portion 1008, an insert 1012 and 1014, a cap portion 1016, and a knob portion 1018. The sports bat 1000 will be discussed in greater detail below.

The portion 400 is implemented in accordance with a multi-layered design and includes a first layer 402 and a second layer 404 that is adjacent to the first layer 402. The second layer 404 is formed adjacent to the first layer 402 via electro-deposition. However, it is contemplated that the second layer 404 can be formed using any other suitable manufacturing technique.

The first layer 402 is implemented as a substrate and is formed of any suitable material, such as a fibrous material, foam, a ceramic, a metal, a metal alloy, a polymer, or a composite. Thus, for example, the first layer 402 can be formed of wood; an aluminum alloy, such as a 6000-series aluminum alloy or a 7000-series aluminum alloy; a steel alloy; a scandium alloy; a thermoplastic or thermoset polymer, such as a copolymer of acrylonitrile, butadiene, and styrene; a carbon/thermoset resins composite, such as a graphite (aka carbon) fiber/thermoset resins composite; a fiberglass/thermoset resins composite; a poly-paraphenylene terephthalamide fiber/thermoset resins composite, such as a Kevlar® brand fiber/thermoset resins composite, where Kevlar® brand fibers are available from DuPont Inc., Wilmington, Del.; or a polyethylene fiber/thermoset resins composite, such as a Spectra® brand fiber/thermoset resins composite, where Spectra® brand fibers are available from Honeywell International Inc., Morristown, N.J. The selection of a material forming the first layer 402 can be dependent upon a variety of considerations, such as its ability to facilitate formation of the second layer 404, its ability to be molded or shaped into a desired form, and desired characteristics of the portion 400.

While not illustrated in FIG. 1, it is contemplated that the first layer 402 can be formed so as to include two or more sub-layers, which can be formed of the same material or different materials. For certain implementations, at least one of the sub-layers can be formed of a conductive material, such as in the form of a coating of a metal. As can be appreciated, such implementation of the first layer 402 can be referred to as a "metallized" form of the first layer 402. The conductive material can be deposited using any suitable manufacturing technique, such as metallization in an organic or inorganic bath, aerosol spraying, electro-less deposition, chemical vapor deposition, physical vapor deposition, or any other suitable coating or printing technique. Such metallized form can be desirable, since the conductive material can facilitate formation of the second layer 404 as well as provide enhanced durability and strength to the portion 400.

The second layer 404 is implemented as a coating and is formed of a nanostructured material. Thus, for example, the second layer 404 can be formed of n-Ni, n-Ni Co, n-Ni Fe, n-Co P, n-Ni P, n-Cu, n-Zn, n-Zn Ni, n-Zn Fe, n-Ag, n-Au, n-Pt, n-Fe, or a composite thereof, such as a $B_4C$/n-Ni P composite, a $MoS_2$/n-Fe composite, or a carbon nanotube/n-Ni Fe composite. The selection of the nanostructured material can be dependent upon a variety of considerations, such as desired characteristics of the portion 400.

During use, the second layer 404 can be positioned so that it is exposed to an outside environment, thus serving as an outer coating. It is also contemplated that the second layer 404 can be positioned so that it is adjacent to an internal compartment, thus serving as an inner coating. Referring to FIG. 1, the second layer 404 at least partly covers a surface 406 of the first layer 402. Depending on characteristics of the first layer 402 or a specific manufacturing technique used, the second layer 404 can extend below the surface 406 and at least partly permeate the first layer 402. While two layers are illustrated in FIG. 1, it is contemplated that the portion 400 can include more or less layers for other implementations. In particular, it is contemplated that the portion 400 can include a third layer (not illustrated in FIG. 1) that is formed of the same or a different nanostructured material. It is also contemplated that the portion 400 can be implemented in accordance with an electroformed design, such that the first layer 402 serves as a temporary substrate during formation of the second layer 404. Subsequent to the formation of the second layer 404, the first layer 402 can be separated using any suitable manufacturing technique.

Depending upon specific characteristics desired for the portion 400, the second layer 404 can cover from about 1 to about 100 percent of the surface 406 of the first layer 402. Thus, for example, the second layer 404 can cover from about 20 to about 100 percent, from about 50 to about 100 percent, or from about 80 to about 100 percent of the surface 406. When mechanical characteristics of the portion 400 are a controlling consideration, the second layer 404 can cover a larger percentage of the surface 406. On the other hand, when other characteristics of the portion 400 are a controlling consideration, the second layer 404 can cover a smaller percentage of the surface 406. Alternatively, or in conjunction, when balancing mechanical and other characteristics of the portion 400, it can be desirable to adjust a thickness of the second layer 404.

In some instances, the second layer 404 can have a thickness that is in the range from about 10 μm to about 5 mm. Thus, for example, the second layer 404 can have a thickness that is at least about 10 μm, such as at least about 25 μm or at least about 30 μm, and up to about 5 mm, such as up to about 400 μm or up to about 100 μm.

For certain implementations, the second layer 404 can represent from about 1 to about 100 percent of a total weight of the portion 400. Thus, for example, the second layer 404 can represent at least about 5 percent of the total weight, such as at least about 10 percent or at least about 20 percent, and up to about 95 percent of the total weight, such as up to about 85 percent or up to about 75 percent. When mechanical characteristics of the portion 400 are a controlling consideration, the second layer 404 can represent a larger weight percentage of the portion 400. On the other hand, when other characteristics of the portion 400 are a controlling consideration, the second layer 404 can represent a lower weight percentage of the portion 400. Alternatively, or in conjunction, when balancing mechanical and other characteristics of the portion 400, it can be desirable to adjust a thickness of the second layer 404 or a percentage of the surface 406 that is covered by the second layer 404.

In some instances, the second layer 404 can be formed so as to provide substantially uniform characteristics across the surface 406 of the first layer 402. Thus, as illustrated in FIG. 1, the nanostructured material is substantially uniformly distributed across the surface 406. Such uniformity in distribution can serve to reduce or prevent the occurrence of a weak spot at or near a section of the portion 400 that includes a lesser amount of the nanostructured material than another section. However, depending upon specific characteristics desired for the portion 400, the distribution of the nanostructured material can be varied from that illustrated in FIG. 1. Thus, for example, the nanostructured material can be distributed non-linearly across the surface 406 to match a stress profile of the first layer 402 under service loads or meet a set of mass characteristics requirements, such as center of gravity, balance point, inertia, swing weight, or total mass.

During formation of the portion 400, the first layer 402 is positioned in a plating tank that includes a suitable plating solution. It is also contemplated that a plating rack, a plating barrel, a plating brush, or a plating drum can be used in place of, or in conjunction with, the plating tank. In some instances, a set of additives can be added when forming the plating solution. Next, electrical connections are formed between the first layer 402, which serves as a cathode, and at least one anode, and the second layer 404 can be deposited on the surface 406 of the first layer 402 using any suitable electrodeposition technique, such as direct current ("DC") electrodeposition, pulse electro-deposition, or some other current waveform electro-deposition. Thus, for example, the second layer 404 can be deposited by transmitting a set of direct current cathodic-current pulses between the anode and the cathode and by transmitting a set of direct current anodic-current pulses between the cathode and the anode. After the second layer 404 is formed on the surface 406, the second layer 404 can be further strengthened by applying a suitable heat treatment.

Figure 2:
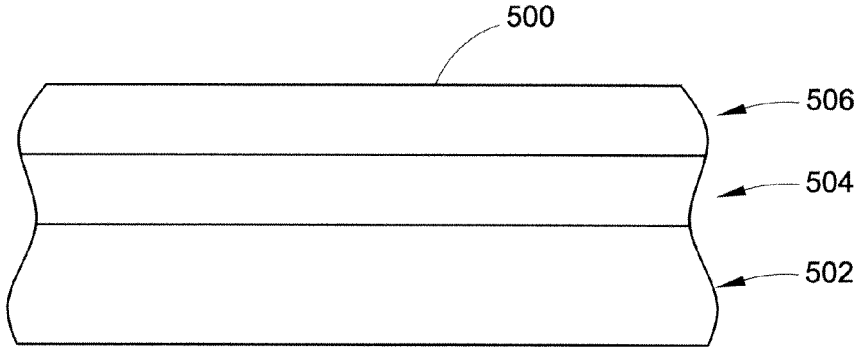
FIG. 2 illustrates a cross-sectional schematic view of a portion of a sports bat, according to another embodiment of the invention, with a nanostructured material in a sandwich construction.

With reference to FIG. 2, a cross-sectional schematic view of a portion 500 of a sports bat, according to another embodiment of the invention is illustrated. The portion 500 is implemented in accordance with a multi-layered design and includes a first layer 502, a second layer 504 that is adjacent to the first layer 502, and a third layer 506 that is adjacent to the second layer 504. In particular, the portion 500 includes a laminate structure that is formed via a lay-up of the layers 502, 504, and 506, and at least one of the layers 502, 504, and 506 is formed of a nanostructured material. While three layers are illustrated in FIG. 2, it is contemplated that the portion 500 can include more or less layers for other implementations.

The first layer 502 and the third layer 506 are formed of any suitable materials, such as fibrous materials, foams, ceramics, metals, metal alloys, polymers, or composites. Thus, for example, at least one of the first layer 502 and the third layer 506 can be formed of a graphite fiber/thermoset resins composite. As can be appreciated, a graphite fiber/thermoset resins composite can have any of a variety of forms, such as uniaxial, biaxial, woven, and pre-impregnated, filament wound, tape-layered, or a combination thereof. The selection of materials forming the first layer 502 and the third layer 506 can be dependent upon a variety of considerations, such as their ability to facilitate formation of the second layer 504, their ability to be molded or shaped into a desired form, and desired characteristics of the portion 500.

During formation of the portion 500, the first layer 502 serves as an inner ply to which the second layer 504 and the third layer 506 are sequentially added as a middle ply and an outer ply, respectively. Once properly positioned with respect to one another, the layers 502, 504, and 506 are coupled to one another using any suitable fastening mechanism, such as through inter-laminar shear strength of thermoset resins, an additional chemical adhesive paste, or an adhesive thin film added before a standard cure cycle that can optionally involve vacuum pressure. The portion 500 can be formed with a variety of shapes using hand lay-up, tape-layering, filament winding, bladder molding, or any other suitable manufacturing technique.

Figure 3:
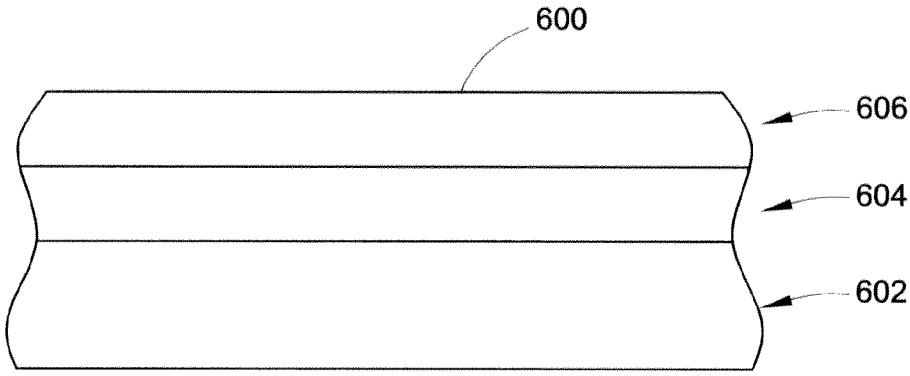
FIG. 3 illustrates a cross-sectional schematic view of a portion of a sports bat, according to another embodiment of the invention, with a nanostructured material in a sandwich construction with different nanostructured materials on the top and bottom.

With reference to FIG. 3, a cross-sectional schematic view of a portion 600 of a sports bat, according to another embodiment of the invention is illustrated. The portion 600 is implemented in accordance with a multi-layered design and includes a first layer 602, a second layer 604 that is adjacent to the first layer 602, and a third layer 606 that is adjacent to the second layer 604. In particular, the portion 600 includes a laminate structure that is formed via a lay-up of the layers 602, 604, and 606, and at least one of the layers 602, 604, and 606 is formed of a nanostructured material. While three layers are illustrated in FIG. 3, it is contemplated that the portion 600 can include more or less layers for other implementations.

The first layer 602 and the third layer 606 are formed of the same nanostructured material or different nanostructured materials. The selection of the nanostructured materials can be dependent upon a variety of considerations, such as their ability to be molded or shaped into a desired form and desired characteristics of the portion 600. In the illustrated embodiment, the first layer 602 and the third layer 606 are formed as foils, sheets, or plates using similar electrodeposition settings as previously described with reference to FIG. 1. It is also contemplated that the layers 602 and 606 can be formed using any other suitable manufacturing technique. The resulting layers 602 and 606 can have characteristics that are similar to those previously described with reference to FIG. 1.

The second layer 604 is formed of a visco-elastic material that exhibits high vibration damping. The selection of the visco-elastic material can be dependent upon a variety of other considerations, such as its ability to be molded or shaped into a desired form. An example of the visco-elastic material is a visco-elastic polymer that is based on polyether and polyurethane, such as Sorbothane® brand polymers that are available from Sorbothane, Inc., Kent, Ohio. Advantageously, the use of the visco-elastic material allows the second layer 604 to serve as a constrained, vibration damping layer, thus reducing vibrations and providing a desired feel upon impact.

During formation of the portion 600, the first layer 602 serves as an inner ply to which the second layer 604 and the third layer 606 are sequentially added as a middle ply and an outer ply, respectively. Once properly positioned with respect to one another, the layers 602, 604, and 606 are coupled to one another using any suitable fastening mechanism, such as though inter-laminar shear strength of thermoset resins, an additional chemical adhesive paste, or an adhesive thin film added before a standard cure cycle that can optionally involve vacuum pressure. The portion 600 can be formed with a variety of shapes using hand lay-up, tape-layering, filament winding, bladder molding, or any other suitable manufacturing technique.

Figure 4:
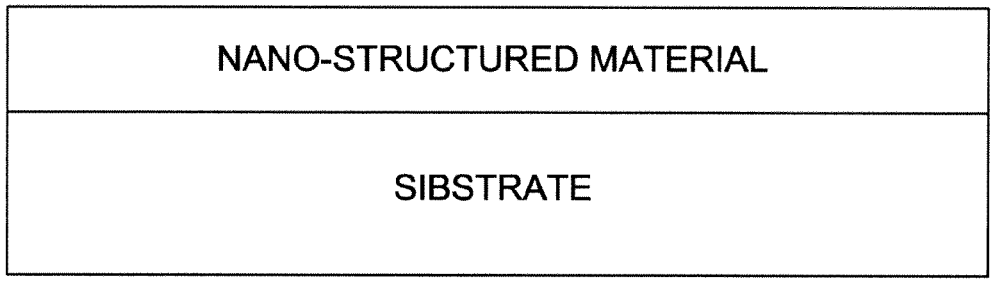
FIG. 4 illustrates a cross-sectional schematic view of a portion of a sports bat, according to another embodiment of the invention, with a nanostructured material providing a structural shell or coating over an Al, polymer or Mg substrate or core.
Figure 5:
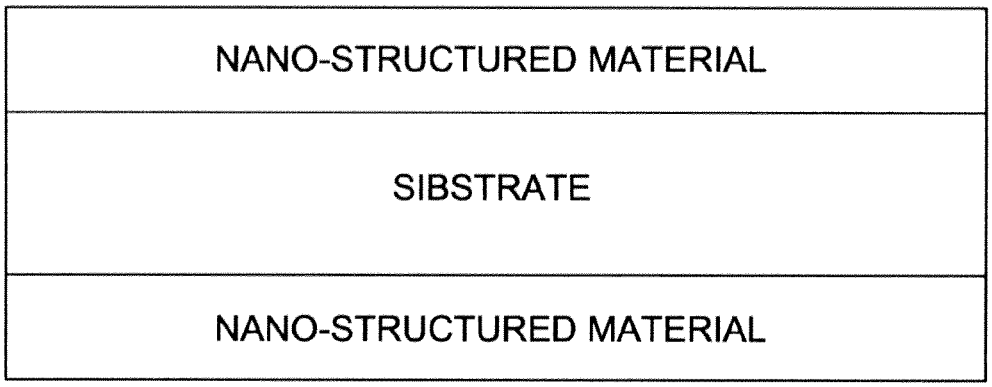
FIG. 5 illustrates a cross-sectional schematic view of a portion of a sports bat, according to another embodiment of the invention, with a nanostructured material in a sandwich construction on the top and bottom and Al, polymer or Mg as the substrate or core.
Figure 6:
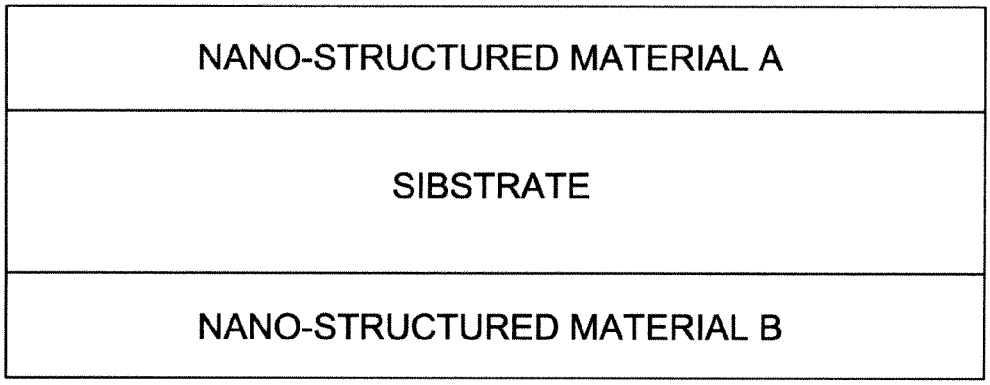
FIG. 6 illustrates a cross-sectional schematic view of a portion of a sports bat, according to another embodiment of the invention, with a nanostructured material in a sandwich construction with different nanostructured materials on the top and bottom and Al, polymer or Mg as the substrate or core.
Figure 7:
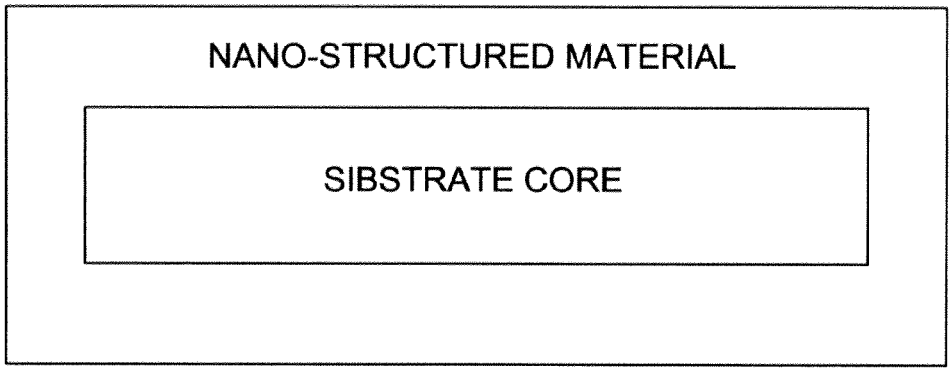
FIG. 7 illustrates a cross-sectional schematic view of a portion of a sports bat, according to another embodiment of the invention, with nanostructured materials fully encapsulating an Al, polymer or Mg substrate or core.

With reference to FIGS. 4-7, cross-sectional schematic views of a portion of a sports bat, according to embodiments of the invention which are similar to the those described above with respect to FIGS. 1-3, are illustrated. FIG. 4 illustrates a sports bat with a nanostructured material and a substrate. FIG. 5 illustrates a sports bat with a nanostructured material in a sandwich construction and a substrate. FIG. 6 illustrates a sports bat with a nanostructured material in a sandwich construction with different nanostructured materials and a substrate. FIG. 7 illustrates a sports bat with nanostructured materials fully encapsulating a substrate. It should be appreciated that both the nanostructured material and substrate shown in FIGS. 4-7 can have a variable thickness.

Figure 8:
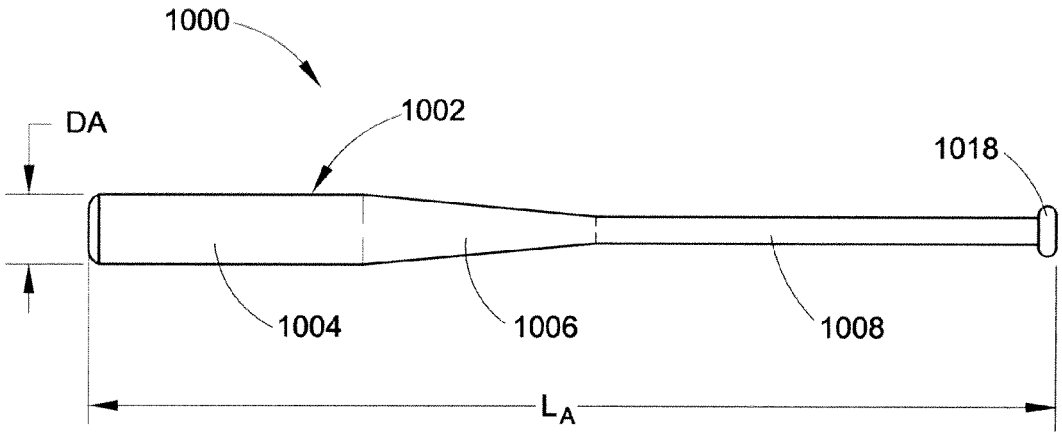
FIG. 8 is a side elevational view a sports bat, according to another embodiment of the invention.
Figure 9:
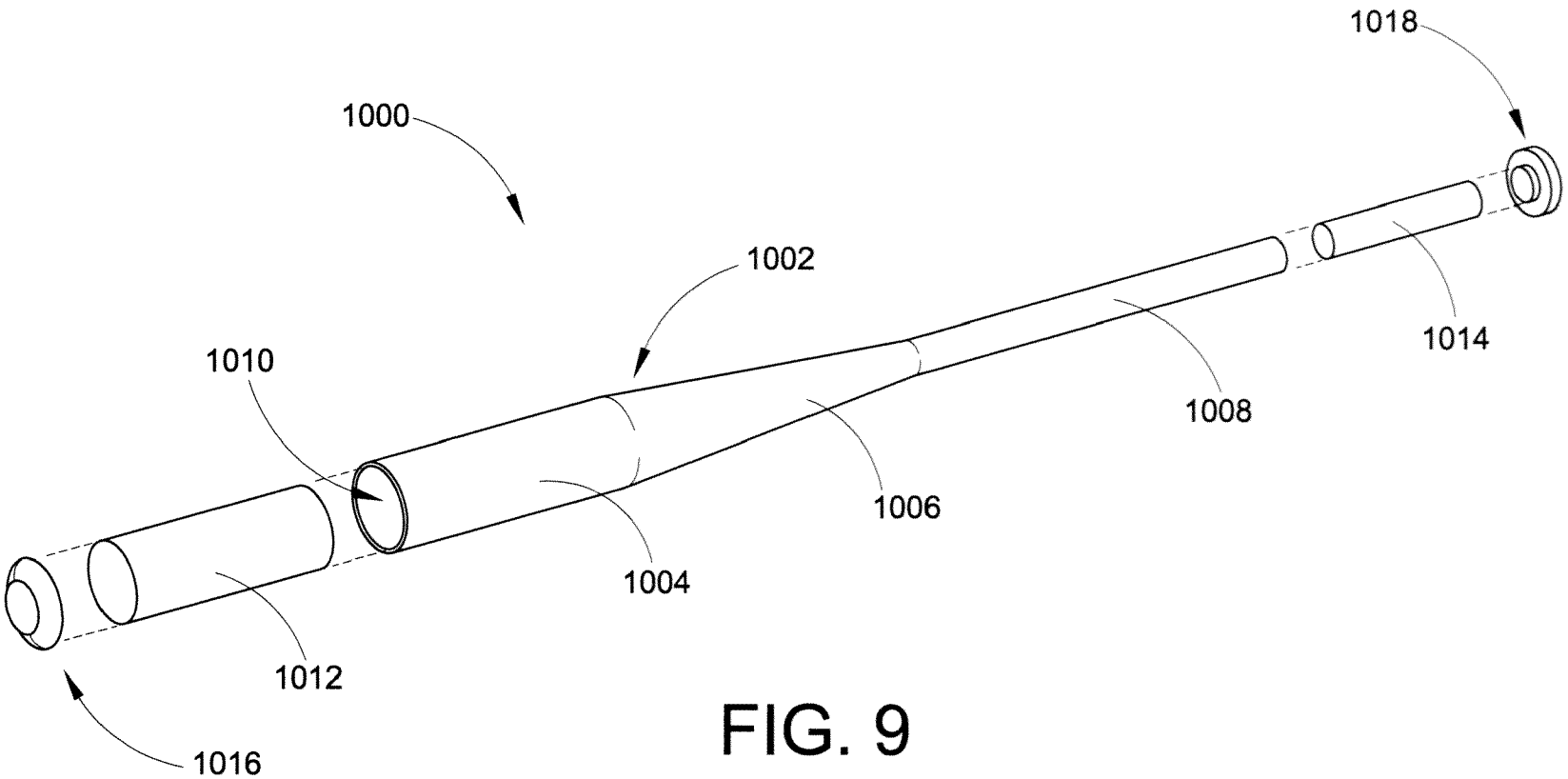
FIG. 9 is an exploded view of the sports bat of FIG. 8.

With reference now to FIGS. 8 and 9, the sports bat 1000 can comply with guidelines specified by a baseball governing body or a softball governing body, such as for a Youth Baseball League, a Senior Baseball League, an Adult Baseball League, a Fast-Pitch Softball League, or a Slow-Pitch Softball League (e.g., ASA. USSSA or NCAA). Thus, for example, the sports bat 1000 can have a length $L_A$ that is in the range from about 71.1 cm (or about 28 inches) to about 81.3 cm (or about 32 inches) as specified for a Youth Baseball League or a Senior Baseball League, or in the range from about 78.7 cm (or about 31 inches) to about 86.4 cm (or about 34 inches) as specified for an Adult Baseball League. As another example, the sports bat 1000 can have an outer diameter DA that is about 5.7 cm (or about 2.25 inches), about 6.4 cm (or about 2.5 inches), about 6.7 cm (or about 2.62 inches) or about 6.98 cm (or about 2.75 cm). As a further example, the sports bat can exhibit an efficiency of energy transfer that is within a specified range. This efficiency of energy transfer can be specified in terms of, for example, a Ball Exit Speed Ratio ("BESR"), a Batted Bali Speed ("BBS"), a Bat Performance Factor ("BPF") or a Coefficient of Restitution ("COR"). It is also contemplated that the sports bat can be implemented as a batting-practice bat or a training bat and, thus, need not comply with any such guidelines.

As indicated previously, the sports bat 1000 comprises a body portion 1002. The body portion includes a barrel portion 1004 and a handle portion 1008. The body portion 1002 also includes a tapered portion 1006 that is positioned between and adjacent to the barrel portion 1004 and the handle portion 1008. In the illustrated embodiment, the barrel portion 1004, the tapered portion 1006, and the handle portion 1008 are formed integrally with respect to one another. However, it is contemplated that these portions 1004, 1006, and 1008 can be formed separately and can be coupled to one another using any suitable fastening mechanism. The body portion 1002 has a cross-sectional shape that is substantially circular. However, it is contemplated that the body portion 1002 can have any of a variety of other cross-sectional shapes.

At least one of the barrel portion 1004, the tapered portion 1006, and the handle portion 1008 is formed at least partially of a nanostructured material, which exhibits a set of desirable characteristics such as high strength, high strength-to-weight ratio, high resilience, high fracture toughness, high elasticity, high vibration damping, high hardness, high ductility, and high wear resistance. For certain implementations, the nanostructured material can form at least one layer of a multi-layered design. Thus, for example, at least one of the barrel portion 1004, the tapered portion 1006, and the handle portion 1008 can include a set of layers, and at least one of the set of layers can be formed of the nanostructured material. A remaining layer of the set of layers can be formed of any suitable material, such as a fibrous material, a ceramic, a metal, a metal alloy, a polymer, or a composite. It is also contemplated that at least one of the barrel portion 1004, the tapered portion 1006, and the handle portion 1008 can be substantially formed of the nanostructured material, such as in the case of an electro-formed design.

Advantageously, the use of the nanostructured material within the body portion 1002 allows sports bats to exhibit improved performance characteristics while being formed in a cost-effective manner. Thus, for example, high resilience of the nanostructured material translates into an enhanced efficiency of energy transfer upon impact and longer hitting distances upon impact at various places along a hitting surface, rather than simply at an optimal location that is sometimes referred to as a "sweet spot" or a "center of percussion." In some instances, this efficiency of energy transfer can be tuned along the body portion 1002 to comply with a limit imposed by a baseball governing body or a softball governing body. Also, high strength-to-weight ratio of the nanostructured material allows sports bats to be strong yet lightweight, while high fracture toughness, high elasticity, high hardness, and high wear resistance of the nanostructured material allow the sports bat 1000 to be durable and to be less prone to buckling, cracks, scratches, and other structural damage. In addition, vibration damping and a desired sound upon impact are achieved when the nanostructured material is electrodeposited onto a suitable substrate, such as aluminum alloys, magnesium alloys, polymers or fiber-reinforced plastics (e.g., graphite/thermoset resins).

As illustrated in FIG. 9, the body portion 1002 defines an internal compartment 1010 within which a pair of inserts 1012 and 1014 are positioned. In particular, the insert 1012 is positioned adjacent to the barrel portion 1004, while the insert 1014 is positioned adjacent to the handle portion 1008. The inserts 1012 and 1014 serve to enhance performance characteristics of the sports bat 1000, such as by providing enhanced balance and enhanced durability. In the illustrated embodiment, the inserts 1012 and 1014 are formed of foam, such as closed-cell foam or open-cell foam. The inserts can have a sleeve-like conformation; although, this is not required.

The sports bat 1000 also includes a cap portion 1016 and a knob portion 1018, which are formed of any suitable materials such as fibrous materials, ceramics, metals, metal alloys, polymers, or composites. The cap portion 1016 and the knob portion 1018 are coupled to respective ends of the body portion 1002 using any suitable fastening mechanism, thus sealing the inserts 1012 and 1014 within the body portion 1002.

The use of specific materials and other specific implementation features can further enhance performance characteristics of sports bats. For example, an amount and a distribution of the nanostructured material can contribute to the performance characteristics of sports bats. It is contemplated that the nanostructured material can be distributed so as to selectively cover those portions of bats that are likely to come into contact with a ball during use, thus providing an improved hitting surface for the bats. In particular, the nanostructured material can form an outer layer of a multi-layered design and can be distributed so as to extend from the cap portion 1016 up through the barrel portion 1004 or up through the tapered portion 1006. It is also contemplated that the nanostructured material can be distributed so as to selectively cover those portions of the sports bats that are likely to come into contact with a player's hands during use, such as the handle portion 1008.

As another example, other portions of sports bats can be formed of the same or a different nanostructured material. In particular, it is contemplated that at least one of the inserts 1012 and 1014 can be formed of a nanostructured material, which can form at least one layer of a foam design. It is also contemplated that at least one of the inserts 1012 and 1014 can be substantially formed of the nanostructured material. The use of the nanostructured material within the inserts 1012 and 1014 can allow the sports bats to exhibit improved performance characteristics, such as enhanced balance, enhanced efficiency of energy transfer upon impact, enhanced strength, enhanced durability, and desired feel and sound upon impact. Likewise, it is contemplated that at least one of the cap portion 1016 and the knob portion 1018 can be formed of a nanostructured material, which can form at least one layer of a multi-layered design. It is also contemplated that at least one of the cap portion 1016 and the knob portion 1018 can be substantially formed of the nanostructured material, such as in the case of an electro-formed design. The use of the nanostructured material within the cap portion 1016 and the knob portion 1018 can allow the sports bats to exhibit improved performance characteristics, such as a desired weight, enhanced balance, enhanced durability, and enhanced coupling strength to the body portion 1002. Also, the use of the nanostructured material within the cap portion 1016 can alter a vibrational frequency response of the sports bats, thus providing a desired feel upon impact.

EXAMPLES

The following examples describe specific features of some embodiments of the invention to illustrate and provide a description for those of ordinary skill in the art. The examples should not be construed as limiting the invention as the examples merely provide specific methodology useful in understanding and practicing some embodiments of the invention.

Example 1

Sports Bats Formed Using Nanostructured Materials

Table 2 below provides examples of sports bats and nanostructured materials that can be used to form these sports bats.

TABLE 2

| Sports Bats | Nanostructured Materials |
|---|---|
| Adult baseball bats | n-Ni, n-Ni Fe, n-Co P and composites thereof |
| Youth baseball bats | n-Ni, n-Ni Fe, n-Co P and composites thereof |
| Senior/Junior league baseball bats | n-Ni, n-Ni Fe, n-Co P and composites thereof |
| Slow pitch softball bats | n-Ni, n-Ni Fe, n-Co P and composites thereof |
| Fast pitch softball bats | n-Ni, n-Ni Fe, n-Co P and composites thereof |
| Training or Fungo bats | n-Ni, n-Ni Fe, n-Co P and composites thereof |

The nanostructured material coated sports bats passed standard peel tests and were exposed to a variety of mechanical and playability tests. The results indicated that the thickness and weight of the aluminum substrate could be substantially reduced if the nanostructured coating was applied. Hybrid nanostructured material/aluminum baseball bats made with thinner and lighter aluminum substrates provided adequate durability and performance even though the overall weight of the sports bats was reduced by 15% to 50%. Similar performance benefits can also be achieved with baseball bats that include substrates formed of carbon/thermoset resins, wood, acrylonitrile butadiene styrene ("ABS"), polyamide, Nylon™, and polypropylene and other engineered polymers with or without particulate loads or fiber reinforcement.

Sports Bat Applications

In one aspect the invention relates to any of a variety of sports equipment and associated components including adult baseball bats, youth baseball bats, slow-pitch softball bats; fast pitch softball bats, or any other type of similar bat or hitting device. These bats are collectively denoted herein as "sports bats" or "nano-bats."

According to an embodiment of the invention, the entire outer surface of a sports bat may be coated with a nanostructured material.

According to an embodiment of the invention, the entire inner surface of a sports bat with a hollow inner surface or surfaces may be coated with a nanostructured material.

According to an embodiment of the invention, patches or sections of nanostructured materials can be formed or coated on selected areas of a sports bat without the need to coat the entire article. In addition, patches or sleeves of nanostructured materials, which need not be uniform in thickness, can be electro-deposited in order to, for example, form a thicker coating on selected sections or sections particularly prone to heavy use, such as on bat handles.

One aspect of the invention relates to the "sweet-spot" of a sports bat. Sports bats designers strive to increase the "sweet-spot" of the bats, i.e. to increase the area of the sports bat over which striking the ball does not result in harsh vibrations felt by the player. A sports bat with a bigger sweet spot is considered more forgiving.

Another aspect of the invention relates to a nanometal layer being coated on an impact surface. A nanometal layer with higher hardness will wear significantly less as compared to the current sports bat surfaces. Thus the performance will be maintained throughout the sports bat's life.

In one embodiment, sports bats made from any aluminum alloy, or other suitable metals and composites, may be electro-plated with different thicknesses between 0.001 inch to 0.010 inch of nanostructured metals (the sports bat substrate alloy can be any metal or alloy). The nanostructured materials can be nickel, nickel iron, cobalt phosphorous or similar materials, and may be applied by a nano-fusion/electro deposition process.

In one embodiment the nanostructured metals have an average grain size that is in the range of 2 nm to 5,000 nm, a yield strength that is in the range of 200 Mega Pascal ("MPa") to 2,750 MPa, and a hardness that is in the range of 100 Vickers to 2,000 Vickers.

In one embodiment an aluminum core may be completely encapsulated by nanostructured metal. The encapsulation increases the stiffness of the structure. In addition, complete encapsulation prevents the possibility of galvanic corrosion of the aluminum alloy core. An illustration of a cross section of one embodiment of complete encapsulation is shown in FIG. 10.

Figure 10A:
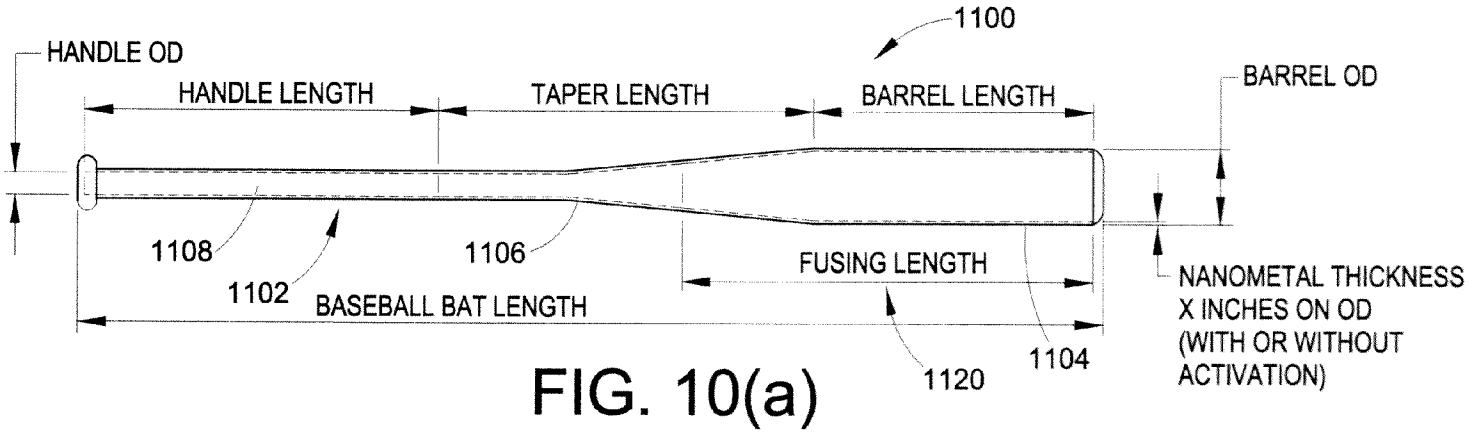
FIG. 10(*a*) is a side cross-sectional view of a sports bat, according to another embodiment of the invention.
Figure 10B:
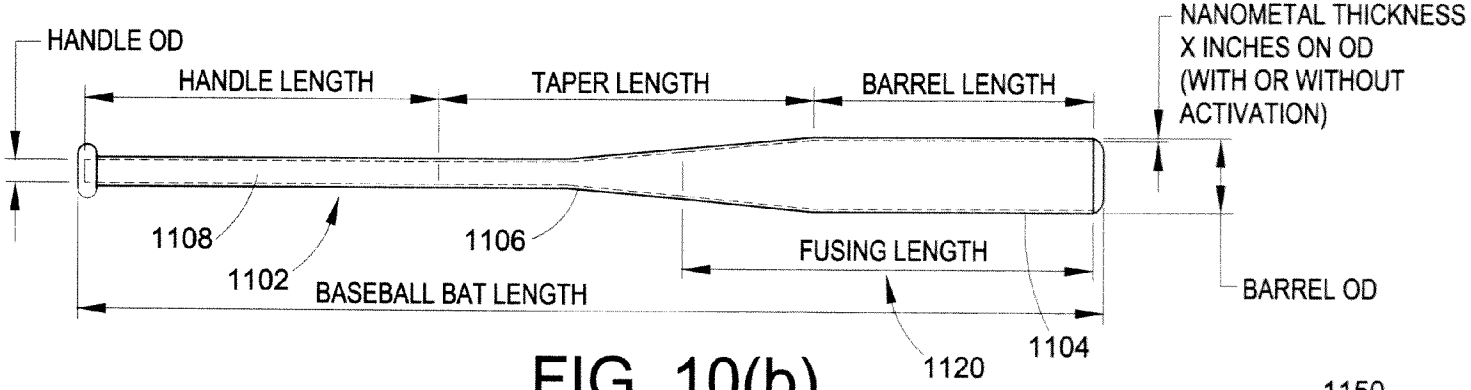
Figure 10C:
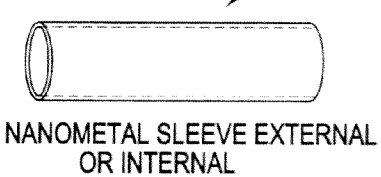

With reference to FIG. 10(*a*) and FIG. 10(*b*), a sports bat 1100 includes a body portion 1102, which includes a barrel portion 1104 and a handle portion 1108. The body portion 1102 also includes a tapered portion 1106 that is positioned between and adjacent to the barrel portion 1104 and the handle portion 1108. The body portion can be made from one of an aluminum alloy, a composite, a polymer and a magnesium alloy. In the illustrated embodiment, the barrel portion 1104, the tapered portion 1106, and the handle portion 1108 are formed integrally with respect to one another. However, it is contemplated that these portions 1104, 1106, and 1108 can be formed separately and can be coupled to one another using any suitable fastening mechanism. The body portion 1102 has a cross-sectional shape that is substantially circular. However, it is contemplated that the body portion 1102 can have any of a variety of other cross-sectional shapes.

The sports bats can have a length that is in the range from about 71.1 cm (or about 28 inches) to about 81.3 cm (or about 32 inches) as specified for a Youth Baseball League or a Senior Baseball League, or in the range from about 78.7 cm (or about 31 inches) to about 86.4 cm (or about 34 inches) as specified for an Adult Baseball League. As another example, sports bats can have an barrel outer diameter that is about 5.7 cm (or about 2.25 inches), about 6.4 cm (or about 2.5 inches), about 6.7 cm (or about 2.625 inches) or about 6.98 cm (or about 2.75 cm). The barrel length is about 8 inches, the taper length is about 11 inches and the handle length is about 10 inches.

At least a portion of the body portion 1102 is one of externally and internally coated or fused with nanostructured material. As shown in FIG. 10(*a*), the portion 1120, which includes at least the barrel portion 1104 and a portion of the taper portion 1106, is externally coated with nanostructured material. As shown in FIG. 10(*b*), the portion 1120, which includes at least the barrel portion 1104 and a portion of the taper portion 1106, is internally coated with nanostructured material. The fusing length of the nanostructured material is about 12 to 14 inches measured from an end of the barrel portion 1104.

It should be appreciated that in lieu of coating the nanostructured material onto the portion, a nanostructured sleeve 1150 can be provided. As shown in FIG. 10(*c*), the sleeve is generally cylindrical in cross-section; although, this is not required. The sleeve can be secured to at least one of an inner surface and an outer surface of the sports bat. For example, to secure the sleeve, at least a section of the portion 1120 can be activated. Alternatively, the sleeve can be mechanically secured to the portion, for example, by a press fit. In this instance, the resilient nature of the sleeve will fixedly secure the sleeve to the sports bat.

Figure 11A:
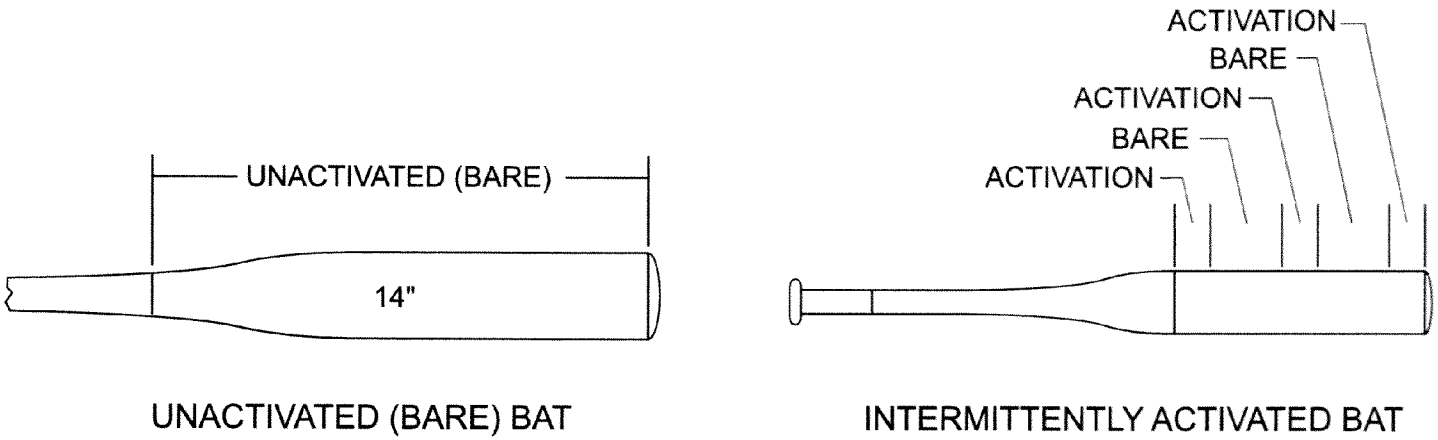
FIG. 11(*a*) illustrates a sports bat with nanostructured material on a barrel portion without activation.
Figure 11B:
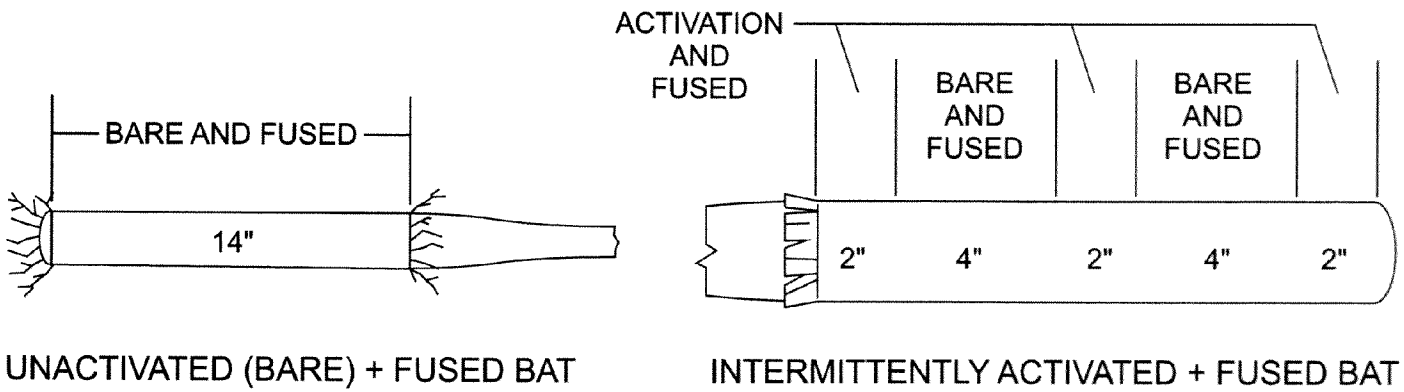
Figure 12A:
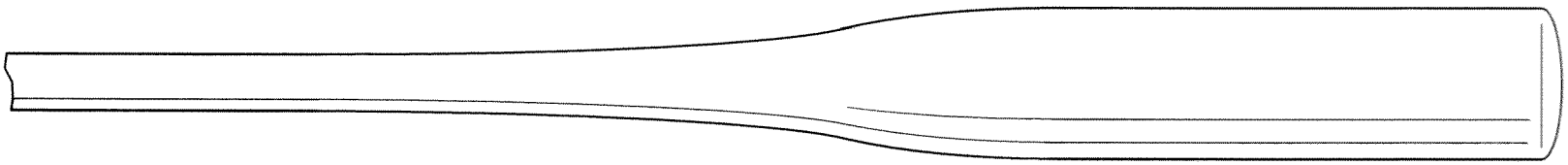
FIGS. 12(*a*)-12(*d*) illustrate sports bats with nanostructured coatings according to aspects of the present invention.
Figure 12B:
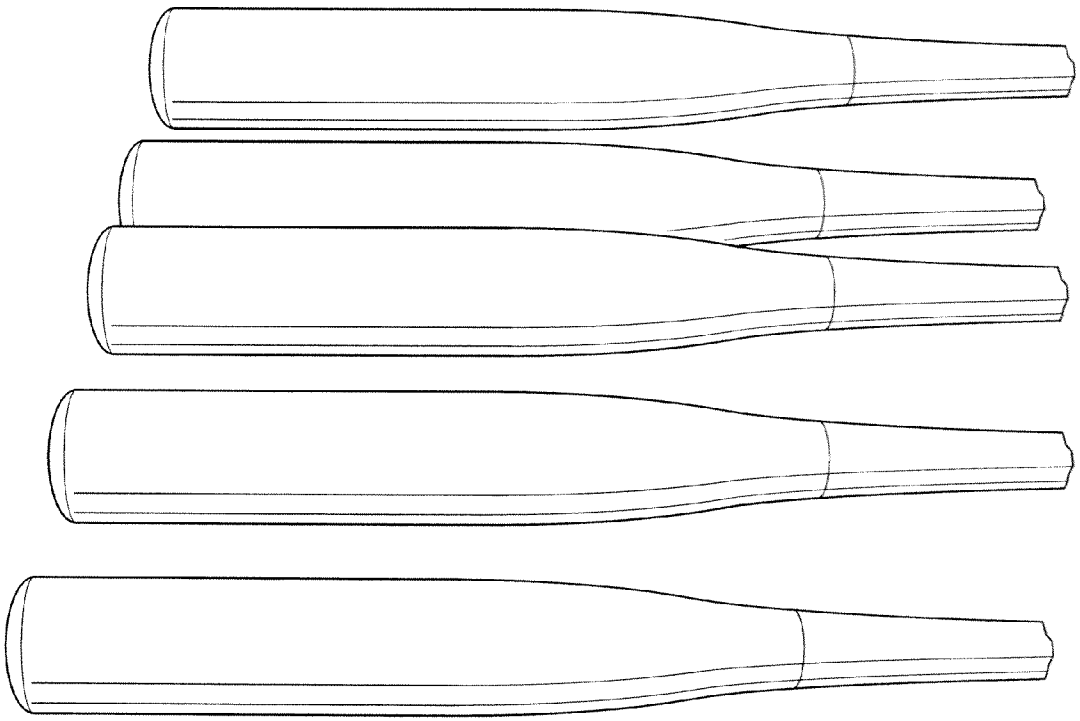
Figure 12C:
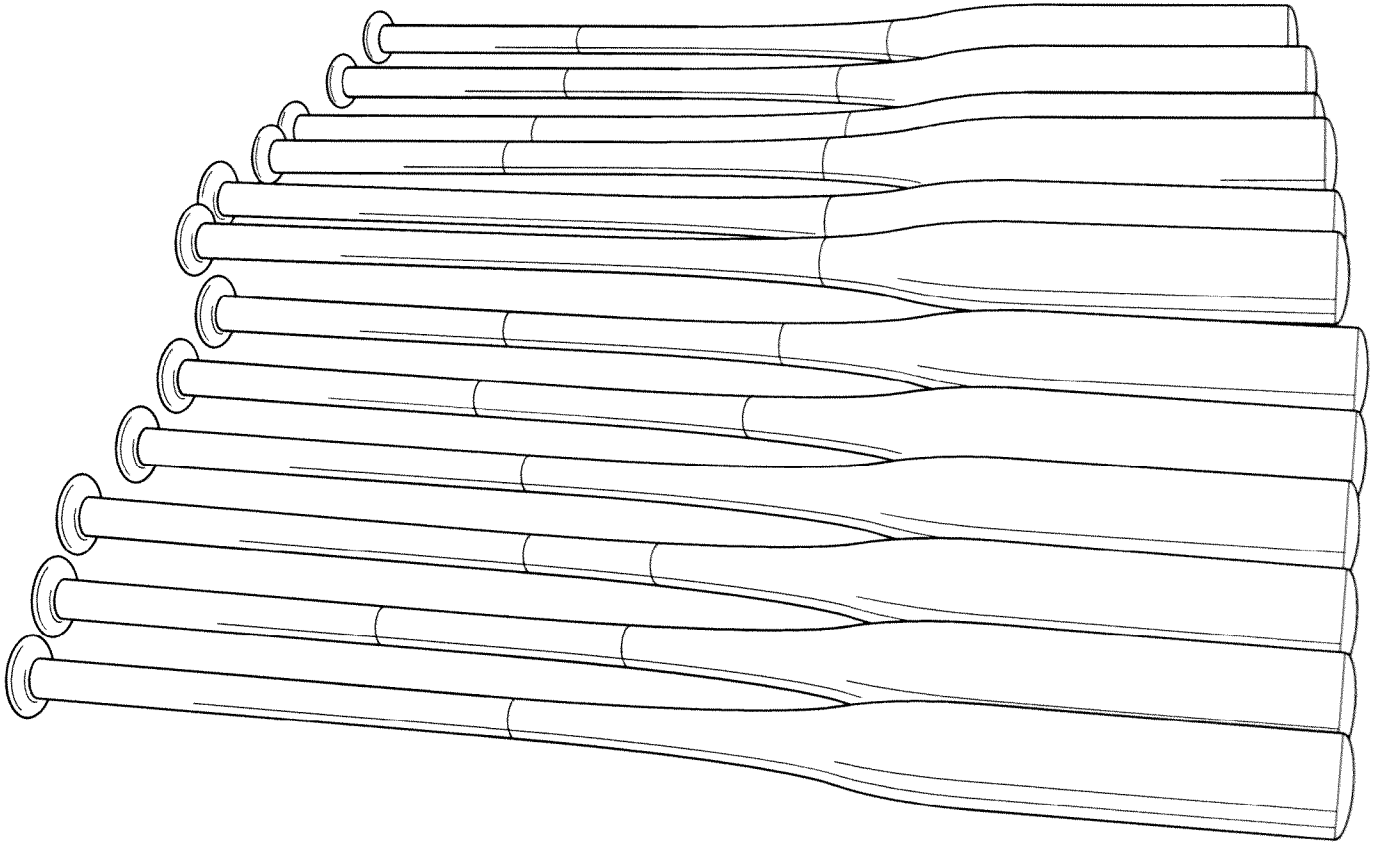
Figure 12D:
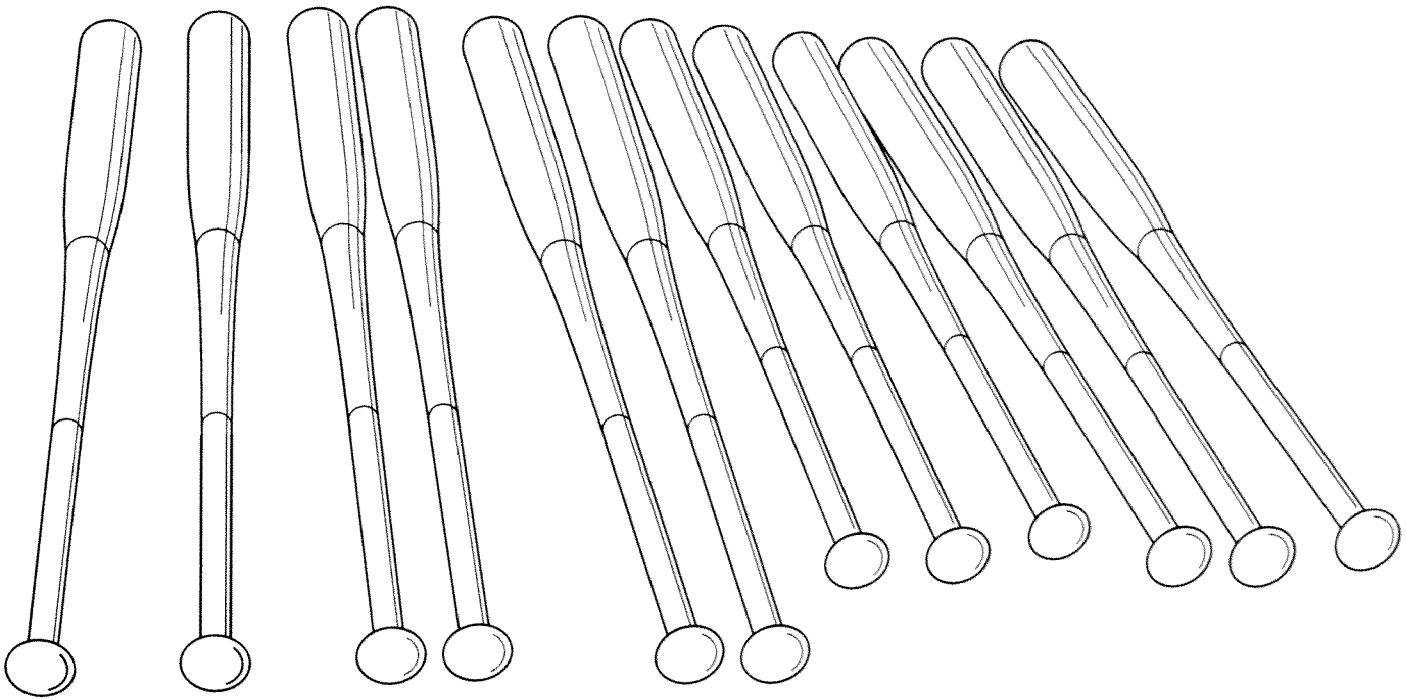

The nanostructured material can be coated or fused with or without activating at least a section of the portion 1120. For example, in one embodiment, the entire portion is activated. In that instance, the coating of the nanostructured material creates a single-wall barrel structure. In another embodiment, the entire portion is not activated. In that instance, the coating of the nanostructured material creates a multi-wall barrel structure (see FIG. 11(*a*)). In yet another embodiment, selected sections of the portion length can be activated (i.e., an intermittent activation, see FIG. 11(*b*)).

In some embodiments, the aluminum alloy core need not be encapsulated symmetrically. For example, the encapsulation width of the body portion 1102 can vary from 0.001 mm to 1 mm. For example, regarding inserts 1012 and 1014, the location of a core in the insert can be chosen depending on the particular application. The encapsulation width along the perimeter of the insert, i.e. the material covering the perimeter of the aluminum alloy core, can be controlled during the deposition process or could be later machined to the design requirement.

In one embodiment, in order to make a bi-metallic sandwich barrel, first start with a core of the sandwich, which may be an aluminum alloy. The core can be any aluminum alloy including the 1XXX pure Al, 2XXX Al—Cu, 3XXX Al—Mn, 4XXX Al—Si, 5XXX Al—Mg, 6XXX Al—Mg—Si, 7XXX Al—Zn 8XXX series, Sc-containing Al alloys, and other Al—Li alloys. It is preferred that the aluminum alloys chosen are in their highest strength temper to make it an effective core. For the heat treatable alloys such as the 7XXX, 6XXX and the 2XXX series it is usually the T6 temper. For non heat-treatable alloys such as 5XXX, the core material should be used preferably in the H temper.

Prior to electro-deposition of nanostructured material, the core may be subjected to an activation process. This process prepares the aluminum surface to be more amenable for adhesion to the deposited nanostructured metal. The activation process may consist of a series of steps aimed at removing the oxide surface on aluminum. Processes such as this are well established and practiced commercially. A final step of the activation process may be chosen to be a copper strike. In this final step a thin layer of copper is deposited using standard electrochemical methods. One example of such a copper strike is the "acid copper."

In another embodiment, the deposition process is carried out in two stages. In the first stage a nanostructured metal having composition A is deposited. In the second stage of the process, nanostructured metal having composition B is deposited. The choice of the alloy composition will depend on the exact design requirement. For example, in some embodiments it is suggested that the alloy compositions be chosen such that the strength of alloy B is greater than alloy A. In another embodiment it is suggested that alloy B have higher fracture toughness as compared to alloy A. In another embodiment it is suggested that alloy have a higher hardness as compared to alloy B. It should be pointed out that whether alloy A or alloy B is used as a strike/impact surface will depend on the properties of the individual compositions.

In one embodiment, the adult baseball, youth baseball, slow-pitch softball, and fast pitch softball bats may be made by coating the aforementioned nanostructured metals, using an electro-deposition method, over a 1 inch to 16 inch length of the barrel section, the hitting area, and a portion of the taper area of the sports bat. Exemplary embodiments are shown in FIGS. 12*a*-12*d*.

Figure 13:
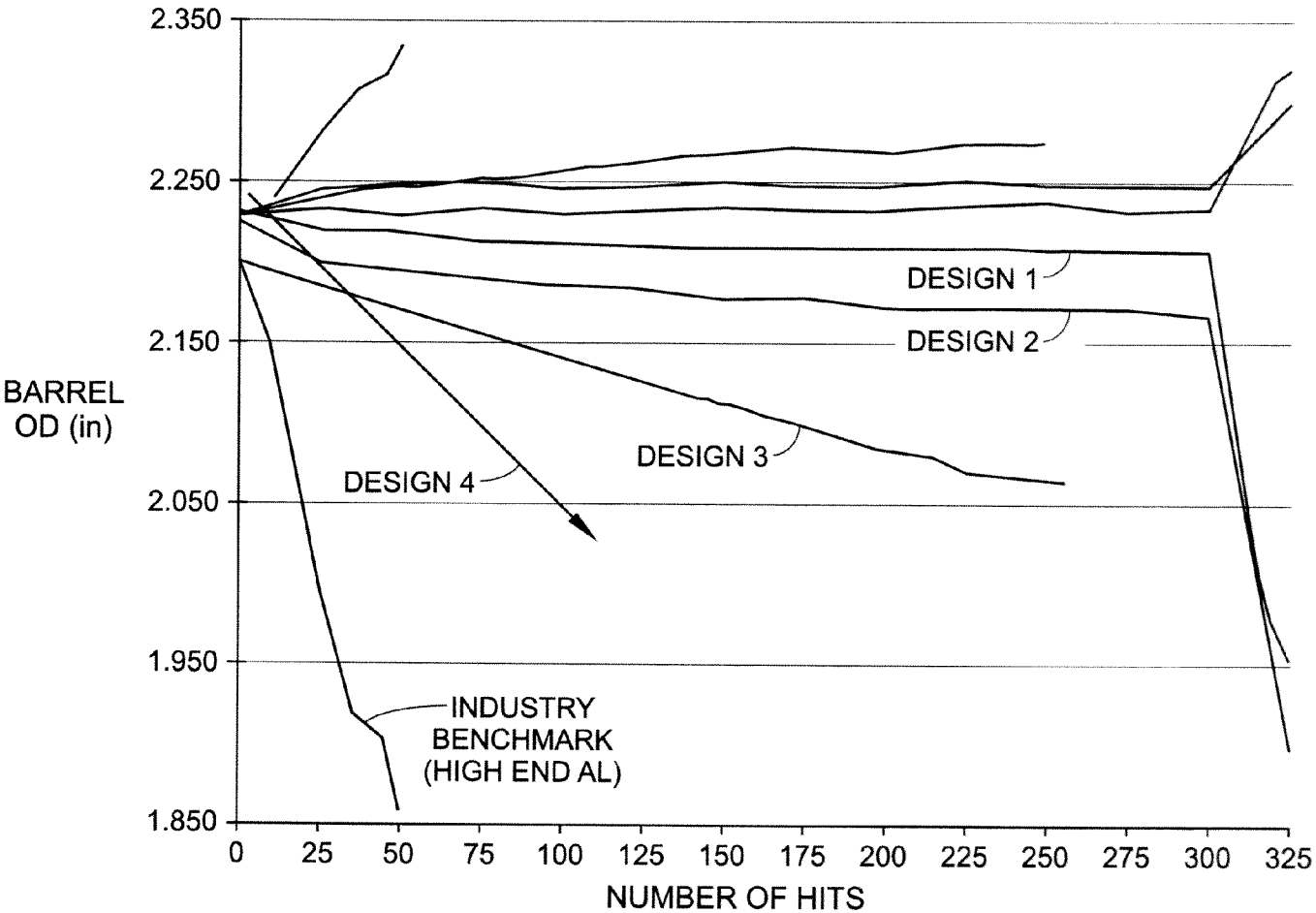
FIG. 13 illustrates durability test results of one embodiment of a sports bat according to the present invention as compared to a commercially available high-end sports bat.

Some embodiments of sports bats according to aspects of the present invention were field and lab tested and showed significantly improved performance durability, sweet spot, feel, and sound. Testing results of some embodiments are shown in Tables 3-5 below and FIG. 13, which depicts that the durability of the enhanced sports bats or nano-bats of the present invention are about four times that of commercial high-end sports bats. Particularly, the nano-bats passed UMASS/BESR simulated durability testing, there being no dents on the nano-bats after 40 shots at 5 axial locations, 8 shots per location at 136 mph impacts with a baseball.

TABLE 3

Quantitative Field Test Data for an Example of Nano-bats
TEST TYPE: CAGE; BALL TYPE: RUBBER; CONTROL: TPX RESPONSE 33", −3

| | PERFORMANCE | | | | | | |
|---|---|---|---|---|---|---|---|
| NANOBAT ID | LINE DRIVE RATING: 1-10 BEST = 10 CONTROL = 5 | DISTANCE RATING: 1-10 BEST = 10 CONTROL = 5 | FEEL/ STING RATING: 1-10 BEST = 10 CONTROL = 5 | SWEET SPOT RATING: 1-10 BEST = 10 CONTROL = 5 | BALANCE RATING: 1-10 TOP HEAVY = 1 CONTROL = 5 | DURABILITY RATING: 1-10 BEST = 10 CONTROL = 5 | SOUND RATING: 1-10 LIKE = 10 CONTROL = 5 |
| NANOBAT NPBB52 | 7 | | 8 | 8 | 7 | | 8 |
| | 8 | | 10 | 8 | 5 | | 8 |
| | 8 | | 10 | 8 | 4 | | 6 |
| AVERAGE | 7.7 | | 9.3 | 8.0 | 5.3 | | 7.3 |
| NANOBAT NPBB55 | 8 | | 7 | 9 | 7 | | 9 |
| | 8 | | 10 | 9 | 8 | | 9 |
| | 7 | | 9 | 8 | 5 | | 6 |
| AVERAGE | 7.7 | | 8.7 | 8.7 | 6.7 | | 8.0 |

TABLE 4

Youth Baseball Bat (Rating 1-10, 10 = Best)
Control Bat: F2/F3, Typhoon, TZ, Composite bats
Ages: 10 to 14
Location: Field & Batting Cage

| Category | Nano-bat | Control Bat |
|---|---|---|
| Performance | 7.2 | 5 |
| Feel/Sting | 7.4 | 5 |
| Sweet Spot | 7.6 | 5 |
| Balance | 8.0 | 5 |
| Sound | 5.3 | 5 |

TABLE 5

Adult Baseball Bat (Rating 1-10, 10 = Best)
Control Bat: Stealth, Havoc, Rebel, EXO, Armor, Response
Ages: 15 to 22
Location: Field & Batting Cage

| Category | Nano-bat | Control Bat |
|---|---|---|
| Performance | 7.7 | 5 |
| Feel/Sting | 9.3 | 5 |
| Sweet Spot | 8.0 | 5 |

TABLE 5-continued

Adult Baseball Bat (Rating 1-10, 10 = Best)
Control Bat: Stealth, Havoc, Rebel, EXO, Armor, Response
Ages: 15 to 22
Location: Field & Batting Cage

| Category | Nano-bat | Control Bat |
|---|---|---|
| Balance | 5.3 | 5 |
| Sound | 7.3 | 5 |

A practitioner of ordinary skill in the art requires no additional explanation in developing the embodiments described herein but may nevertheless find some helpful guidance regarding characteristics and formation of nanostructured materials by examining the patent application of Palumbo et al., U.S. patent application Ser. No. 11/013,456, entitled "Strong, Lightweight Article Containing a Fine-Grained Metallic Layer" and filed on Dec. 17, 2004, and the patent application of Palumbo et al., U.S. patent application Ser. No. 10/516,300, entitled "Process for Electroplating Metallic and Metal Matrix Composite Foils, Coatings and Microcomponents" and filed on Dec. 9, 2004, the disclosures of which are incorporated herein by reference in their entirety.

While the invention has been described with reference to the specific embodiments thereof, it should be understood by those skilled in the art that various changes may be made and equivalents may be substituted without departing from the true spirit and scope of the invention as defined by the appended claims. In addition, many modifications may be made to adapt a particular situation, material, composition of matter, method operation or operations, to the objective, spirit and scope of the invention. All such modifications are intended to be within the scope of the claims appended hereto. In particular, while certain methods may have been described with reference to particular operations performed in a particular order, it will be understood that these operations may be combined, sub-divided, or re-ordered to form an equivalent method without departing from the teachings of the invention. Accordingly, unless specifically indicated herein, the order and grouping of the operations is not a limitation of the invention.

What is claimed is:

1. A sports bat comprising:

a body portion including a barrel portion, a taper portion and a handle portion, wherein at least a portion of the body portion is at least one of externally and internally coated with fine-grained material having an average gain size in the range from 1 to 1,000 nm, and wherein selected sections of said portion coated with the fine-grained material include an activation layer to facilitate adhesion of the fine-grained material to said selected sections and selected sections of said portion coated with the fine-grained material do not include an activation layer.

2. A sports bat of claim 1, wherein said body portion is selected from the group consisting of 1XXX pure Al, 2XXX Al—Cu-alloys, 3XXX, Al—Mn-alloys, 4XXX Al—Si-alloys, 5XXX Al—Mg-alloys, 6XXX Al—Mg—Si-alloys, 7XXX Al—Zn-alloys, 8XXX alloys, Sc-containing Al alloys, Al—Li alloys and Mg alloys.

3. A sports bat of claim 1, wherein said portion is externally coated with the fine-grained material.

4. A sports bat of claim 1, wherein said portion is internally coated with the fine-grained material.

5. A sports bat of claim 1, wherein yield strength of the fine-grained material of said portion is at least about 800 MPa.

6. A sports bat of claim 1, wherein modulus of resilience of the fine-grained material of said portion is at least about 0.15 MPa.

7. A sports bat of claim 1, wherein an elastic limit of the fine-grained material of said portion is at least about 0.75 percent.

8. A sports bat of claim 1, wherein a hardness of the fine-grained material of said portion is at least about 460 Vickers.

9. A sports bat of claim 1, wherein the fine-gained material comprises at least about 2.5 percent by volume of said portion.

10. A sports bat of claim 1, wherein said portion coated with the fine-grained material has a single-wall barrel conformation.

11. A sports bat of claim 1, wherein the fine-grained material has a variable thickness.

12. A sports bat of claim 1, wherein the thickness of the fine-grained material is between approximately 0.001 mm and approximately 1 mm.

13. A sports bat of claim 1, further comprising at least one insert, wherein said body portion defines a chamber dimensioned to receive said at least one insert, wherein at least a portion of said at least one insert is at least one of externally and internally coated with the fine-grained material.

14. A sports bat of claim 13, further comprising a cap portion and a knob portion, said cap portion and said knob portion being coupled to respective ends of the body portion for sealing said at least one insert within said chamber of said body portion, wherein at least one of said cap portion and said knob portion is at least one of externally and internally coated with fine-grained material.

15. A sports bar of claim 14, wherein said at least one insert is substantially formed of the fine-gained material selected from the group consisting of nickel, nickel-phosphorus, nickel-iron, nickel-zinc, cobalt, cobalt-phosphorous, copper, zinc, silver, gold, and platinum.

16. A sports bat of claim 1, further comprising an external sleeve positioned over at least a portion of the body portion.

17. A sports bat of claim 16, wherein at least a section of said portion of the body portion is activated to facilitate adhesion of the sleeve to said portion of the body portion.

* * * * *